US007971811B2

(12) United States Patent
Suzuki et al.

(10) Patent No.: US 7,971,811 B2
(45) Date of Patent: Jul. 5, 2011

(54) DISPOSAL PROCESSING APPARATUS, DISPOSAL PROCESSING INFORMATION MANAGEMENT SYSTEM, AND DISPOSAL PROCESSING METHOD

(75) Inventors: Hitoshi Suzuki, Kanagawa (JP); Hiroyoshi Uejo, Kanagawa (JP); Takashi Sugawara, Kanagawa (JP); Shunsuke Hamasuna, Kanagawa (JP); Ryuuichi Shiraishi, Kanagawa (JP); Kengo Shinozaki, Kanagawa (JP)

(73) Assignee: Fuji Xerox, Co., Ltd., Tokyo (JP)

( * ) Notice: Subject to any disclaimer, the term of this patent is extended or adjusted under 35 U.S.C. 154(b) by 679 days.

(21) Appl. No.: 11/519,806

(22) Filed: Sep. 13, 2006

(65) Prior Publication Data

US 2007/0176031 A1 Aug. 2, 2007

(30) Foreign Application Priority Data

Jan. 31, 2006 (JP) ..... 2006-022700

(51) Int. Cl.
*B02C 25/00* (2006.01)

(52) U.S. Cl. ..... 241/36; 241/101.2

(58) Field of Classification Search ..... 241/36, 241/101.2, 100, 236; 235/375, 476; 358/1.14; 707/100, 101, 204; 700/221, 223, 224; 705/8
See application file for complete search history.

(56) References Cited

U.S. PATENT DOCUMENTS 4,248,389 A 2/1981 Thompson et al.
4,664,317 A * 5/1987 Morton ..... 241/36
5,318,229 A 6/1994 Brown
5,467,169 A 11/1995 Morikawa
5,662,280 A 9/1997 Nishio et al.
5,666,191 A 9/1997 Hasegawa et al.
5,813,009 A 9/1998 Johnson et al.
6,691,918 B1 2/2004 Yoda et al.
6,763,997 B2 * 7/2004 Bennett et al. ..... 235/375
6,895,507 B1 5/2005 Teppler
2002/0055875 A1 5/2002 Schulze et al.
2003/0046545 A1 3/2003 Merkle et al.
2003/0057305 A1 3/2003 Watano et al.
2004/0069883 A1 4/2004 Watanabe et al.
2004/0112998 A1 6/2004 Schmidt et al.
2004/0210755 A1 10/2004 Becker et al.
2005/0067482 A1 3/2005 Wu et al.
2005/0120289 A1 6/2005 Suzuki
2005/0168766 A1 8/2005 Troyansky et al.
2005/0223414 A1 10/2005 Kenrich et al.

(Continued)

FOREIGN PATENT DOCUMENTS

CN 1496283 A 5/2004

(Continued)

OTHER PUBLICATIONS

U.S. Appl. No. 11/404,804, filed on Apr. 17, 2006 in the name of Shunsuke Hamasuna et al.

(Continued)

*Primary Examiner* — Faye Francis
(74) *Attorney, Agent, or Firm* — Oliff & Berridge, PLC

(57) ABSTRACT

A disposal processing apparatus comprises: a disposal processing section that disposes of a recording medium; an arrival detecting section that detects whether the recording medium has reached the disposal processing section; and a judging section that judges whether the recording medium has been disposed of by the disposal processing section based on a detection result of the arrival detecting section.

5 Claims, 5 Drawing Sheets

U.S. PATENT DOCUMENTS

| | | | | |
|---|---|---|---|---|
| 2006/0167580 | A1 | 7/2006 | Whittier | |
| 2006/0200357 | A1 | 9/2006 | Dewey | |
| 2006/0274352 | A1 | 12/2006 | Nakaguma et al. | |
| 2006/0285147 | A1 | 12/2006 | Wolfman et al. | |
| 2006/0290967 | A1 | 12/2006 | Sumitomo et al. | |
| 2007/0019244 | A1 | 1/2007 | Rekiere | |
| 2007/0063082 | A1 | 3/2007 | Coleman | |
| 2007/0075168 | A1 * | 4/2007 | Rodriguez et al. | 241/36 |
| 2007/0147710 | A1 | 6/2007 | Kanamoto et al. | |

FOREIGN PATENT DOCUMENTS

| | | | |
|---|---|---|---|
| DE | 196 09 435 | A1 | 9/1996 |
| EP | 0 447 581 | A1 | 9/1991 |
| EP | 0 505 109 | A1 | 9/1992 |
| EP | 0 559 473 | A1 | 9/1993 |
| EP | 1 011 261 | A2 | 6/2000 |
| EP | 1 195 202 | A1 | 4/2002 |
| EP | 1 462 988 | A1 | 9/2004 |
| GB | 2 292 734 | A | 3/1996 |
| JP | A-08-328683 | | 12/1996 |
| JP | A-11-085577 | | 3/1999 |
| JP | A-2000-042440 | | 2/2000 |
| JP | A-2002-024076 | | 1/2002 |
| JP | A-2002-368966 | | 12/2002 |
| JP | A 2003-062476 | | 3/2003 |
| JP | A-2005-190365 | | 7/2005 |
| JP | A-2005-244600 | | 9/2005 |
| JP | A-2005-262135 | | 9/2005 |
| JP | A-2006-102572 | | 4/2006 |
| JP | A-2007-004431 | | 1/2007 |
| WO | WO 02/072270 | A1 | 9/2002 |
| WO | WO 2005/103884 | A1 | 11/2005 |

OTHER PUBLICATIONS

U.S. Appl. No. 11/513,195, filed on Aug. 31, 2006 in the name of Shusaku Kubo et al.
U.S. Appl. No. 11/519,807, filed on Sep. 13, 2006 in the name of Hiroyoshi Uejo et al.
U.S. Appl. No. 11/519,850, filed on Sep. 13, 2006 in the name of Ryuuichi Shiraishi et al.
U.S. Appl. No. 11/519,827, filed on Sep. 13, 2006 in the name of Kengo Shinozaki et al.
U.S. Appl. No. 11/519,803, filed on Sep. 13, 2006 in the name of Shunsuke Hamasuna et al.
U.S. Appl. No. 11/519,760, filed on Sep. 13, 2006 in the name of Takashi Sugawara et al.
Office Action issued in U.S. Appl. No. 11/519,827 on Aug. 6, 2010.
Office Action issued in U.S. Appl. No. 11/519,807 on Sep. 3, 2010.
Office Action mailed Jul. 9, 2008 in U.S. Appl. No. 11/404,804.
Office Action mailed Jan. 14, 2009 in U.S. Appl. No. 11/404,804.
Office Action mailed May 19, 2009 in U.S. Appl. No. 11/404,804.
Notice of Allowance mailed Oct. 20, 2009 in U.S. Appl. No. 11/404,804.
Office Action mailed Nov. 20, 2008 in U.S. Appl. No. 11/513,195.
Office Action mailed Jun. 4, 2009 in U.S. Appl. No. 11/513,195.
Office Action mailed Feb. 25, 2010 in U.S. Appl. No. 11/513,195.
Office Action mailed Jun. 1, 2010 in U.S. Appl. No. 11/513,195.
Office Action mailed Dec. 31, 2008 in U.S. Appl. No. 11/519,807.
Office Action mailed Jul. 8, 2009 in U.S. Appl. No. 11/519,807.
Office Action mailed Jan. 11, 2010 in U.S. Appl. No. 11/519,807.
Office Action mailed Aug. 5, 2008 in U.S. Appl. No. 11/519,850.
Office Action mailed Mar. 17, 2009 in U.S. Appl. No. 11/519,850.
Office Action mailed Sep. 14, 2009 in U.S. Appl. No. 11/519,850.
Office Action mailed Feb. 23, 2010 in U.S. Appl. No. 11/519,827.
Office Action mailed Sep. 8, 2009 in U.S. Appl. No. 11/519,803.
Office Action mailed Feb. 2, 2010 in U.S. Appl. No. 11/519,803.
Office Action mailed Jun. 26, 2008 in U.S. Appl. No. 11/519,760.
Office Action mailed Jul. 31, 2009 in U.S. Appl. No. 11/519,760.
Notice of Allowance mailed Feb. 26, 2010 in U.S. Appl. No. 11/519,760.

* cited by examiner

DISPOSAL PROCESSING APPARATUS, DISPOSAL PROCESSING INFORMATION MANAGEMENT SYSTEM, AND DISPOSAL PROCESSING METHOD

BACKGROUND (i) Technical Field

The present invention relates to a disposal processing apparatus, a disposal processing information management system, and a disposal processing method for disposing of a recording medium.

(ii) Background Art

A secret document management system is known which manages secret documents by disposing of a secret document by cutting it after acquiring and storing the information contained in it.

SUMMARY

A disposal processing apparatus comprises: a disposal processing section that disposes of a recording medium; an arrival detecting section that detects whether the recording medium has reached the disposal processing section; and a judging section that judges whether the recording medium has been disposed of by the disposal processing section based on a detection result of the arrival detecting section.

BRIEF DESCRIPTION OF THE DRAWINGS

Exemplary embodiments of the present invention will be described in detail based on the following figures, wherein.

DETAILED DESCRIPTION

An exemplary embodiment of the present invention will be hereinafter described with reference to the drawings.

Figure 1:
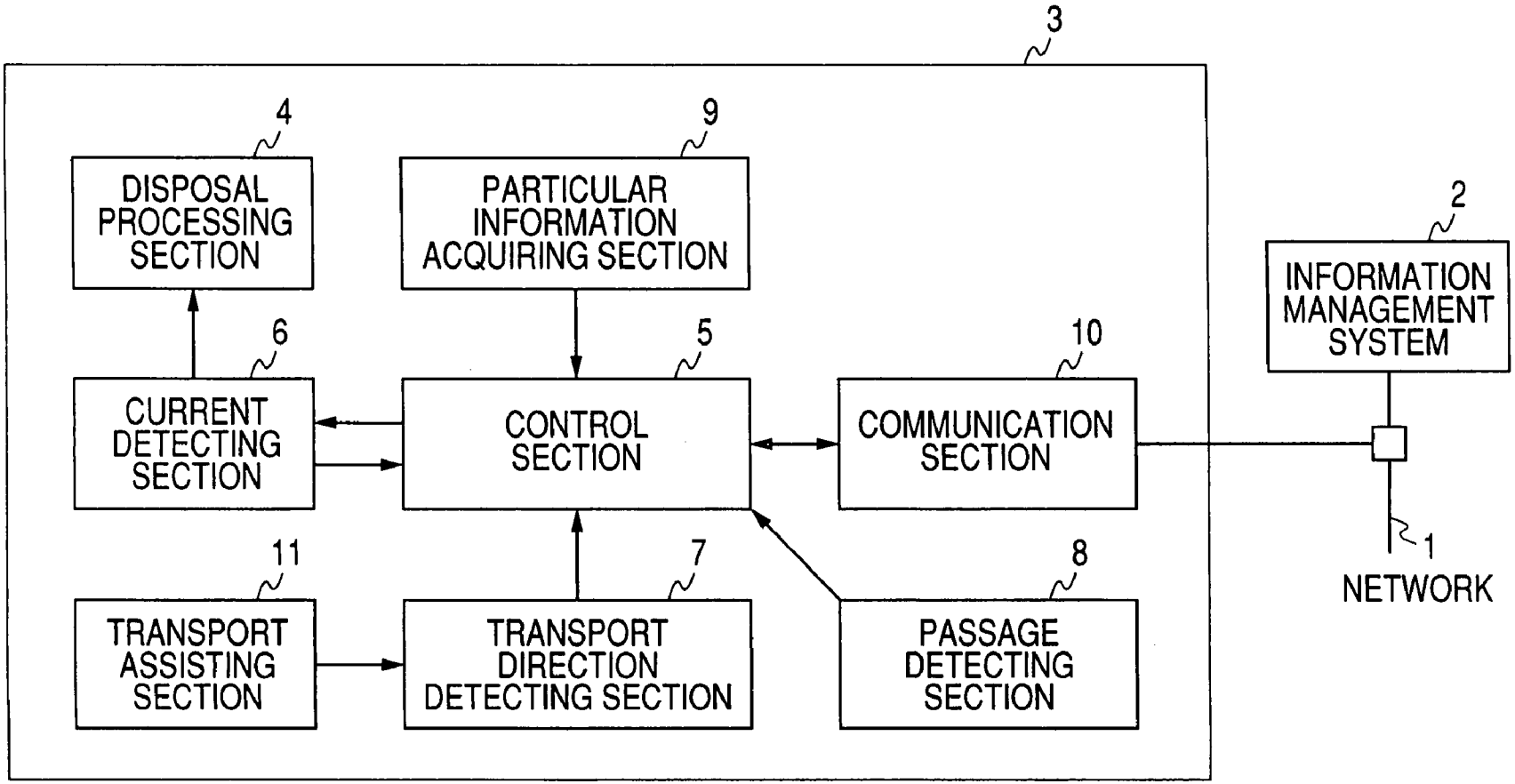
FIG. 1 is a block diagram of a disposal processing apparatus according to an exemplary embodiment of the present invention.

FIG. 1 is a block diagram of a disposal processing apparatus 3 according to the exemplary embodiment of the invention. As shown in FIG. 1, the disposal processing apparatus 3 which disposes of a recording medium is composed of a particular information acquiring section 9 for acquiring particular information that is attached to a recording medium, a disposal processing section 4 for actually disposing of the recording medium, a current detecting section 6 for detecting a current consumption of a motor (not shown) which is part of the disposal processing section 4, a transport assisting section 11 for assisting transport of the recording medium to the disposal processing section 4 through rotation of rollers, a transport direction detecting section 7 for detecting whether the recording medium has reached the disposal processing section 4 on the basis of rotation directions of the rollers, a passage detecting section 8 disposed upstream of the disposal processing section 4, for detecting a passage of the recording medium, a control section 5 for judging whether the disposal processing section 4 has succeeded in disposing of or failed to dispose of the recording medium on the basis of pieces of detection information supplied from the respective detecting section (this is the feature relating to the judging section of claim 1) and for receiving the particular information from the particular information acquiring section 9 and instructing the disposal processing section 4 to perform disposal processing, and a communication section 10 for notifying information supplied from the control section 5 of an external network 1 and notifying information supplied externally of the control section 5.

For example, the recording medium may be a writable and readable disc-shaped recording medium such as a DVD (digital versatile disc), a CD (compact disc), a floppy (trademark) disk, or a hard disc drive on which electronic information is recorded, or a recording medium bearing information printed with ink, toner, or the like (e.g., a paper medium). This exemplary embodiment is directed to a case that the recording medium is a paper medium on which information is printed with ink, toner, or the like.

The particular information attached to the recording medium is management information that is stored in a radio chip as in the case of RFID (radio frequency identification) or two-dimensionally coded management information such as a QR (quick response) code printed on a paper medium or the like. More specifically, the management information such information as a date and time of generation of information printed on a paper medium, its generator, a date and time of printing on the paper medium, a person who performed the printing, a date and time of disposal of the paper medium bearing the printed information, a person who performed the disposal, a period when disposal is permitted, a period when disposal is prohibited, and persons who have disposal authority. This exemplary embodiment is directed to a case that the particular information is management information that is a QR code printed on a paper medium.

The particular information acquiring section 9 is an information acquiring device which performs communication by radio if the particular information is recorded in a radio chip and is an image sensor such as a two-dimensional CCD (charge-coupled device) if the particular information is a QR code (coded information) printed on a paper medium or the like. This exemplary embodiment is directed to a case that the particular information acquiring section 9 is a two-dimensional CCD.

The disposal processing section 4 is to process a recording medium to make it unusable. More specifically, the disposal processing section 4 crushes or smashes into pieces or cuts a recording medium by rotating a cutter with a motor. The disposal processing section 4 of this exemplary embodiment has a motor as a drive source. The details of the disposal processing section 4 will be described later with reference to FIG. 2.

The details of the transport direction detecting section 7 and the passage detecting section 8 will be described later with reference to FIG. 3 and the figures following it.

Figure 2:
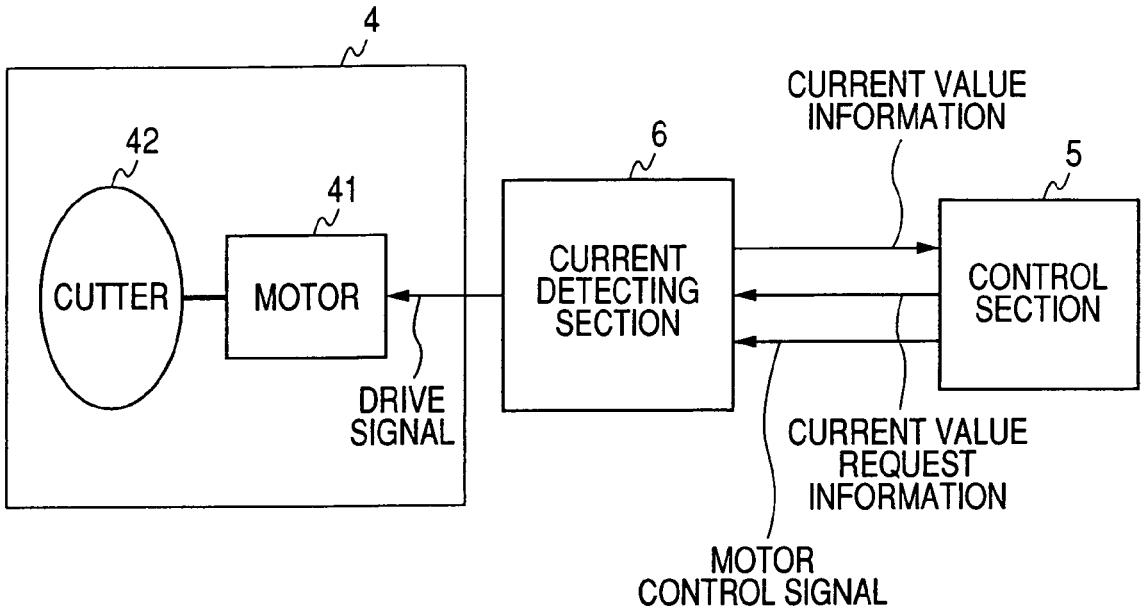
FIG. 2 is a block diagram including a disposal processing section 4 and related section of the exemplary embodiment.

FIG. 2 is a block diagram including the disposal processing section 4 and related section. To make it easier to understand the correspondence between the block diagrams of FIGS. 1 and 2, common components are given the same reference numerals in these drawings. In this exemplary embodiment, the current detecting section 6 is specifically a motor driver. The motor 41 of the disposal processing section 4 is driven by the current detecting section 6 (motor driver) and the current detecting section 6 is controlled by the control section 5. The control section 5 sends current value request information to the current detecting section 6 every prescribed time. Every time the current detecting section 6 receives current value request information, it sends a current value of the motor 41 to the control section 5. The current consumption of the motor 41 can be monitored by employing an inverter motor and an inverter as the motor 41 and the motor driver, respectively. If the inverter does not have a current consumption detecting function, a current detection circuit capable of detecting a current supplied to the inverter may be provided separately, in which case the current detection circuit sends a current value to the control section 5.

Figure 5:
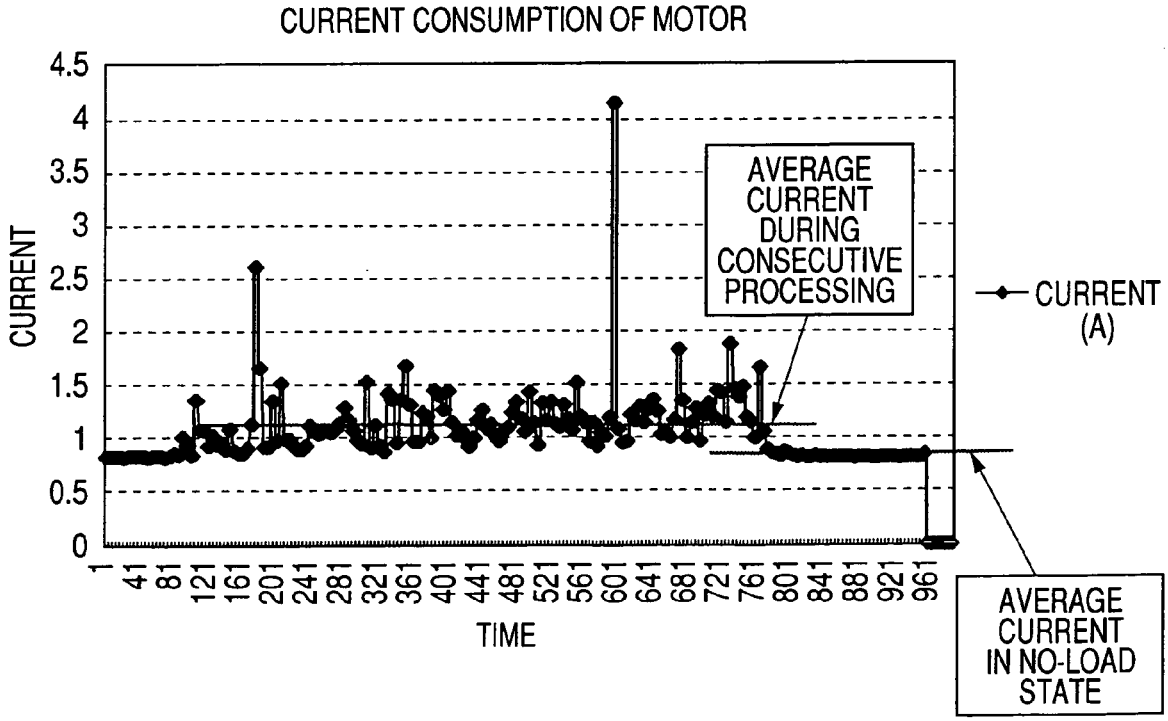
FIG. 5 shows an exemplary detection result of a current detecting section of the exemplary embodiment.

FIG. 5 shows current consumption of the motor 41. FIG. 5 is a graph showing a state that the disposal processing section 4 is processing paper media consecutively and a state that the disposal processing section 4 is processing no paper media and the motor 41 is idling (no-load state). As shown in FIG. 5, there is a difference between an average current consumption in the consecutive processing state and that in the no-load state. Based on this characteristic, a current threshold value to be used for judging whether the disposal processing section 4 is in a state that it is processing paper media consecutively or in an idling state that it is processing no paper media is set in advance in the control section 5 of this exemplary embodiment. The control section 5 judges whether the disposal processing section 4 is in a paper media continuous processing state or in a no-load state by comparing a current value sent from the current detecting section 6 with the preset threshold value. Details will be described later by using a flowchart.

Figure 3:
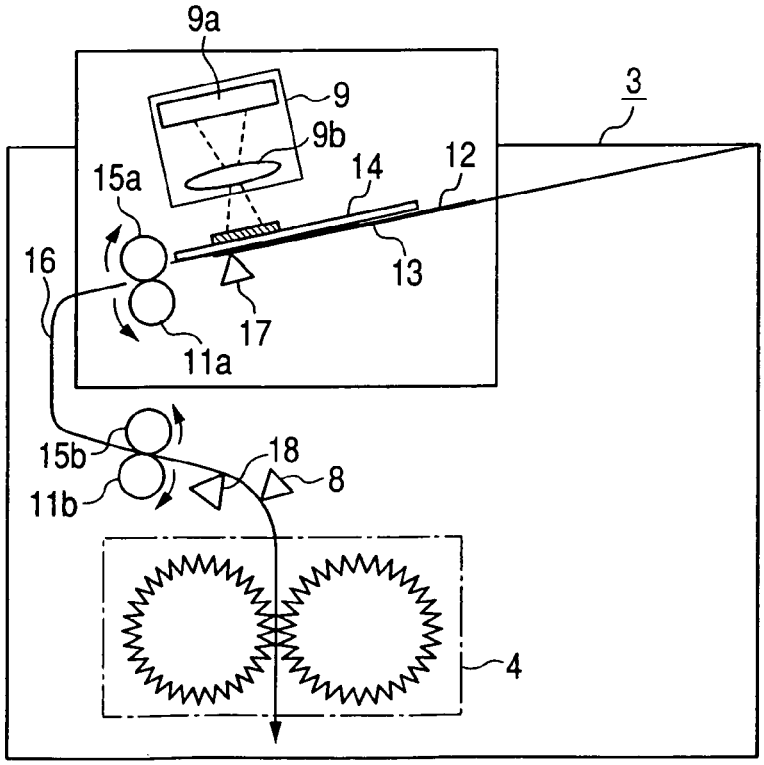
FIG. 3 schematically shows the physical configuration of the disposal processing apparatus according to the exemplary embodiment.

FIG. 3 shows the physical configuration of the disposal processing apparatus 3 according to the exemplary embodiment. To make it easier to understand the correspondence between the block diagram of FIG. 1 and FIG. 2 showing the physical configuration, common components are given the same reference symbols in these drawings. The two-dimensional CCD as the particular information acquiring section 9 of this exemplary embodiment is composed of a lens 9*b* and a two-dimensional photoelectric converting section 9*a*. A paper medium 13 as a subject of disposal is placed on a document tray unit 12. In this state, the paper medium 13 is detected by an in-sensor 17. Management information of a document that is a QR code 14 (coded information) printed on the paper medium 13 is read by the two-dimensional CCD 9 by using a detection signal of the in-sensor 17 as a trigger. The management information read by the two-dimensional CCD 9 is sent to the control section 5. The disposal processing apparatus 3 sends the acquired particular information to an information management system 2 shown in FIG. 1 via the communication section 10. The information management system 2 collates the received data with the contents of a particular information database and sends disposal permission/prohibition information to the disposal processing apparatus 3. If information that enables a disposal permission/prohibition judgment based on management information read by the two-dimensional CCD 9 is stored in the disposal processing apparatus 3 in advance, it is not necessary to access the information management system 2. If disposal of the paper medium 13 is permitted, the control section 5 drives a recording medium transport section 15 and thereby transports the paper medium 13 to the disposal processing section 4.

The paper medium 13 whose QR code 14 has been read by the two-dimensional CCD 9 is transported to the disposal processing section 4 by transport rollers 15*a* and 15*b* which are driven by a motor (not shown). Transport assisting section 11*a* and 11*b* are opposed to the respective transport rollers 15*a* and 15*b*. In this exemplary embodiment, each of the transport assisting section 11*a* and 11*b* is a roller that does not provide drive force and it is desirable that its surface is covered with a material having a large coefficient of friction. As the transport rollers 15*a* and 15*b* rotate, the transport assisting section 11*a* and 11*b* are rotated because of the friction between the contact surfaces of the transport roller 15*a* and the transport assisting section 11*a* and the friction between the contact surfaces of the transport roller 15*b* and the transport assisting section 11*b*. Arrows in FIG. 3 show forward rotation directions for transport of the paper medium 13. While the paper medium 13 is being transported, it is sandwiched between the contact surfaces of the transport roller 15*a* and the transport assisting section 11*a* and between the contact surfaces of the transport roller 15*b* and the transport assisting section 11*b*. Even in such a situation, the transport assisting section 11*a* and 11*b* are rotated in the forward directions for transport of the paper medium 13 because of the friction between the contact surfaces of the paper medium 13 and each of the transport assisting section 11*a* and 11*b*.

If the motor (not shown) for driving the transport rollers 15*a* and 15*b* is set so as to be able to rotate only in such a direction as to transport a paper medium 13 to the disposal processing section 4, the transport assisting section 11*a* and 11*b* do not rotate in the directions opposite to the directions indicated by the arrows in FIG. 3 unless the paper medium 13 is transported forcibly or removed in the direction opposite to the direction of transport to the disposal processing section 4.

Figure 4:
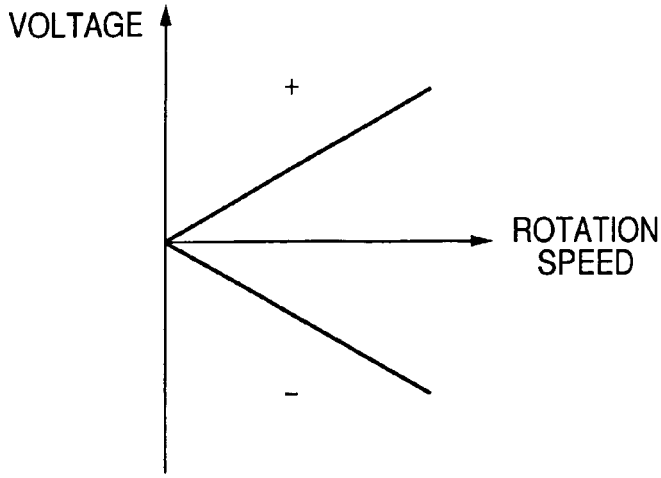
FIG. 4 shows a relationship between the rotation speed and the output voltage of a transport direction detecting section of the exemplary embodiment.

As shown in the block diagram of FIG. 1, the transport assisting section 11 are connected to the transport direction detecting section 7. In this exemplary embodiment, the transport direction detecting section 7 detect a transport direction of a paper medium 13 by detecting whether the rotation directions of the transport assisting section 11 are the forward directions or the backward directions. More specifically, in this exemplary embodiment, each transport direction detecting section 7 is a DC generator which generates a voltage in accordance with rotation of the associated transport assisting section 11 (see FIG. 4). Output signals of the transport direction detecting section 7 are sent to the control section 5. For example, the control section 5 can judge that the transport direction is the forward direction if the output voltages of the transport direction detecting section 7 are positive and that the transport direction is the backward direction if the output voltages of the transport direction detecting section 7 are negative.

Although in this exemplary embodiment the transport assisting section 11 are disposed between the document tray unit 12 and the disposal processing section 4, the invention is not limited to each a case. For example, a transport direction of a paper medium 13 may be detected by providing the transport assisting section 11 in such a manner that they press, from above, the paper medium 13 placed on the document tray unit 12. In this case, the paper medium 13 placed on the document tray unit 12 is located at such a position that a user can pull it out most easily. Therefore, this structure is effective in detecting or preventing pulling-out of a paper medium 13. As a further alternative, the transport assisting section 11 may be provided as parts of the document tray unit 12 which is located under a paper medium 13. This structure is effective in transporting, from below, a bundle of paper media 13 placed on the document tray unit 12 to the disposal processing section 4.

The passage detecting section 8 is to detect whether a paper medium 13 has passed a transport passage 16. An output signal of the passage detecting section 8 is supplied to the control section 5. In this exemplary embodiment, the passage detecting section 8 is specifically a photointerrupter which receives light emitted by itself. When a paper medium 13 is passing the photointerrupter, the paper medium 13 interrupts emitted light and hence the photointerrupter cannot receive the light. When a paper medium 13 is not passing the photointerrupter, the paper medium 13 does not interrupt emitted light and hence the photointerrupter can receive the light. As such, the photointerrupter outputs a detection signal indicating a passage state of a paper medium 13 on the basis of a light detection state. It is ideal to dispose the passage detecting section 18 immediately before the disposal processing section 4.

Recognizing a transport direction detection result of the transport direction detecting section 7, a paper medium 13 passage detection result of the passage detecting section 8, and a detection result of a current consumption of the motor 41 of the disposal processing section 4, the control section 5 judges whether a paper medium 13 has been disposed of or not. If judging that the paper medium 13 has not been disposed of, the control section 5 stops the transport section 15 to prevent the next paper medium 13 from being transported to the disposal processing section 4. The control section 5 sends a paper medium 13 disposal processing result to the information management system 2 via the communication section 10 together with the judgment result of the control section 5, abnormal operation occurrence/non-occurrence information (abnormal operation: a paper jam of a paper medium 13 in the transport passage, a stop of operation of the apparatus 3 due to manipulation of an emergency stop button, or the like), and management information read by the two-dimensional CCD 9. The control section 5 also displays the disposal processing result on a display section (not shown).

Although not shown in FIG. 3, if an IC card recognition device or a biometric authentication device such as a fingerprint authentication device or a vein pattern authentication device is connected, as a personal identification authenticating section, to the disposal processing apparatus 3 according to the exemplary embodiment of the invention, management relating to a person who disposed of a recording medium, permission of recording medium disposal processing, etc. can be performed.

Figure 6:
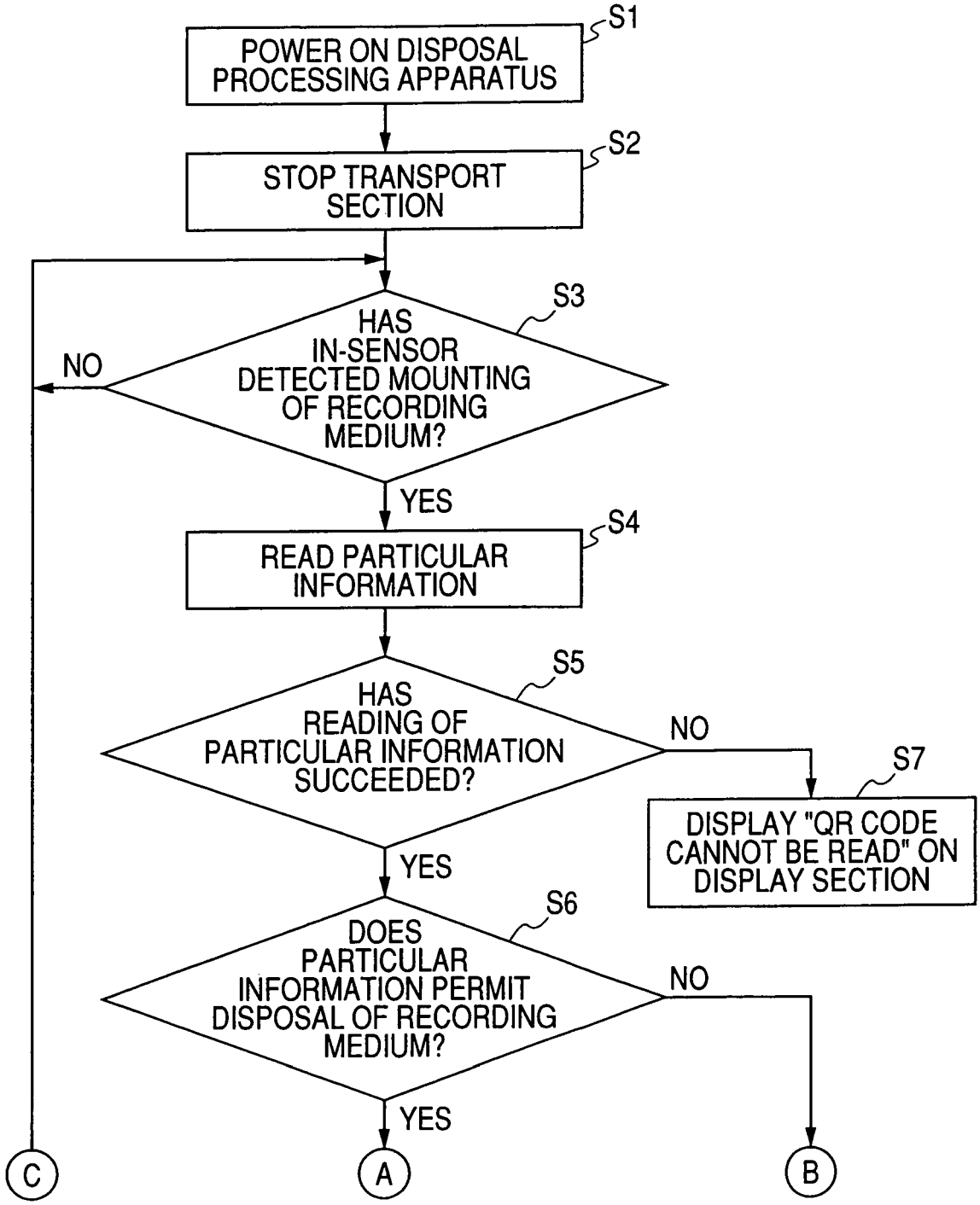
FIG. 6 is a first part of a flowchart showing a general process executed by the disposal processing apparatus according to the exemplary embodiment.
Figure 7:
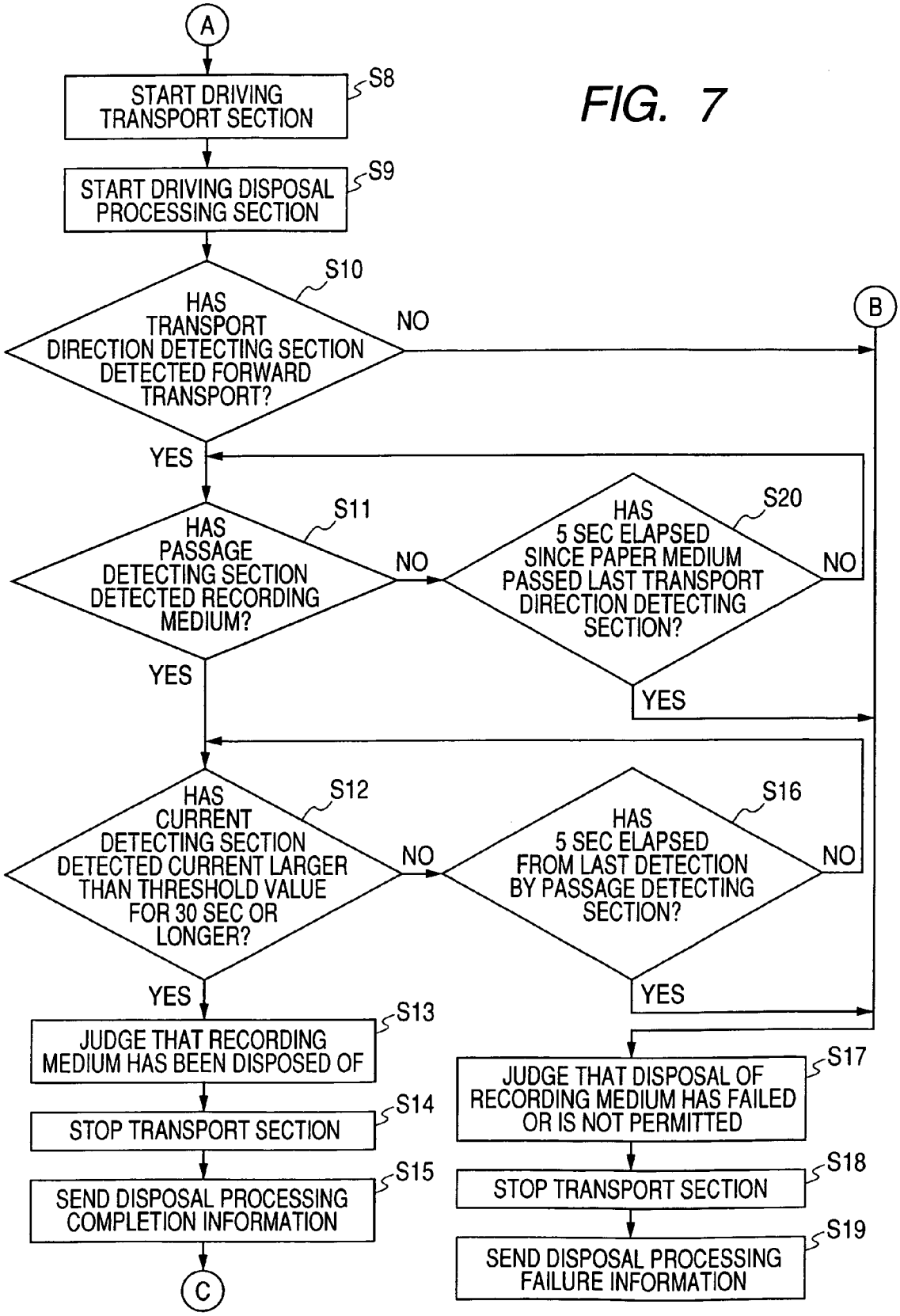
FIG. 7 is a second part of the flowchart showing the general process executed by the disposal processing apparatus according to the exemplary embodiment.

Next, a general process executed by the disposal processing apparatus 3 will be described with reference to a flowchart of FIGS. 6 and 7. First, at step S1, the disposal processing apparatus 3 according to the exemplary embodiment is powered on. At this time, the transport section 15 are not driven (step S2). That is, at this stage, no paper medium 13 is subjected to disposal processing. At step S3, whether a paper medium 13 is placed on the document tray unit 12 is checked with the in-sensor 17. If the in-sensor 17 fails to detect mounting of a paper medium 13, it is attempted again to detect mounting of a paper medium 13 with the in-sensor 17.

If mounting of a paper medium 13 on the document tray unit 12 is detected with the in-sensor 17, at step S5 a QR code 14 printed on the paper medium 13 is read with the two-dimensional CCD 9. If the two-dimensional CCD 9 fails to acquire a QR code 14 (including a case that no QR code is printed on the paper medium 13), at step S7 a message "A QR code cannot be read" is displayed on the display section (not shown) to inform the user that the paper medium 13 placed on the document tray unit 12 cannot be disposed of.

If the two-dimensional CCD 9 succeeds in acquiring a QR code 14, at step S6 the control section 5 decodes the QR code 14 (coded information) and judges, from the decoded information, whether the paper medium 13 placed on the document tray unit 12 is one whose disposal is permitted. If judging that the paper medium 13 is one whose disposal is not permitted (step S17), at step S19 the control section 5 sends disposal processing failure information to the information management system 2 connected to the network 1, via the communication section 10 together with management information contained in the QR code 14.

If the control section 5 has decoded the QR code 14 (coded information) and judges, from the decoded information, that the paper medium 13 placed on the document tray unit 12 is one whose disposal is permitted, at step S8 the control section 5 starts driving the transport section 15 and thereby pulls the paper medium 13 placed on the document tray unit 12 into the transport passage of the disposal processing apparatus 3 according to the exemplary embodiment. At step S9, the control section 5 starts driving the disposal processing section 4.

At step S10, while the paper medium 13 is being transported in the disposal processing apparatus 3, the transport direction detecting section 7 detect whether the paper medium 13 is being transported in the forward direction or not. If the transport direction detecting section 7 detect that the paper medium 13 is being transported in the backward direction, at step S17 the control section 5 judges that the disposal of the paper medium 13 has failed. At step S19, the control section 5 sends disposal processing failure information to the information management system 2 connected to the network 1, via the communication section 10 together with management information contained in the QR code 14.

At step S11, the passage detecting section 8 detects whether the paper medium 13 has passed the transport passage 16 adjacent to which the passage detecting section 8 is disposed. If the passage detecting section 8 does not detect that the paper medium 13 has passed the transport passage 16, at step S20 the control section 5 judges whether a prescribed time has elapsed since the paper medium 13 passed the transport direction detecting section 7 that is closest to the disposal processing section 4 in the transport passage 16. The judgment as to whether the paper medium 13 has passed the transport direction detecting section 7 closest to the disposal processing section 4 is made by judging whether or not a second passage sensor 18 shown in FIG. 3 (physical configuration diagram) has detected a passage of the paper medium 13. A detection signal of the second passage sensor 18 is supplied to the control section 5. In this exemplary embodiment, the prescribed time is set at 5 sec. The prescribed time depends on the transport speed and the positional relationship between the passage detecting section 8 and the second passage sensor 18.

If the prescribed time has elapsed since the paper medium 13 passed the transport direction detecting section 7 closest to the disposal processing section 4, at step S17 the control section 5 judges that the disposal of the paper medium 13 has failed. At step S19, the control section 5 sends disposal processing failure information to the information management system 2 connected to the network 1, via the communication section 10 together with management information contained in the QR code 14. If judging that the prescribed time has not elapsed yet since the paper medium 13 passed the transport direction detecting section 7 closest to the disposal processing section 4, at step S11 the control section 5 again checks whether the passage detecting section 8 has detected a passage of the paper medium 13.

If the passage detecting section 8 detects a passage of the paper medium 13, at step S12 the control section 5 judges whether the current detecting section 6 has detected current that is larger than a preset threshold value for a prescribed time or longer. In this exemplary embodiment, the prescribed time is set at 30 sec. The reason why the condition that current remains larger than the preset threshold value for the prescribed time or longer is employed is to ignore noise etc. If disposal processing is really performed, current should remain larger than the threshold value for the present time or longer. The prescribed time depends on the size of a paper medium and the disposal processing speed.

If current does not remain larger than the threshold value for the present time or longer, at step S16 the control section 5 checks whether a prescribed time has elapsed since the last detection by the passage detecting section 8. In this exemplary embodiment, the prescribed time is set at 5 sec. The prescribed time depends on the transport speed and the positional relationship between the passage detecting section 8 and the disposal processing section 4. If the prescribed time has elapsed, at step S17 the control section 5 judges that the disposal of the paper medium 13 has failed. At step S19, the control section 5 sends disposal processing failure information to the information management system 2 connected to the network 1, via the communication section 10 together with management information contained in the QR code 14. If the prescribed time has not elapsed yet, at step S12 the control section 5 again judges whether the current detecting section 6 has detected current that is larger than the preset threshold value for the prescribed time (in this exemplary embodiment, 30 sec) or longer.

If the current detecting section 6 has detected current that is larger than the preset threshold value for the prescribed time or longer, at step S13 the control section 5 judges that the paper medium 13 has been disposed of normally. At step S14, the control section 5 stops the transport section 15. At step S15, the control section 5 sends disposal processing completion information (meaning that the paper medium 13 has been disposed of normally) to the information management system 2 connected to the network 1, via the communication section 10 together with management information contained in the QR code 14.

Although in this exemplary embodiment the disposal processing apparatus 3 is provided with, as arrival detecting section, all of the current detecting section 6, the transport direction detecting section 7, and the passage detecting section 8, the advantage of the invention that a recording medium that should be disposed of can be disposed of reliably can be attained even if only one of those section is provided. In particular, even if an abnormality such as a jam of a recording medium occurs while it is being transported in the disposal processing apparatus 3, the occurrence of the abnormality can be recognized reliably.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A disposal processing apparatus comprising:

a disposal processing section that disposes of a recording medium, the disposal processing section comprising a cutter that crushes into pieces or cuts the recording medium utilizing rotation of a motor;

an arrival detecting section that detects whether the recording medium has reached the disposal processing section, and includes a current detecting section that detects a current consumption of the motor;

a judging section that judges whether the recording medium has been disposed of completely by the disposal processing section based on a detection result of a total current consumption of the motor being above a predetermined threshold value;

a particular information acquiring section that acquires particular information being attached to the recording medium; and a communication section that notifies, if the judging section judges that the recording medium has been disposed of by the disposal processing section, information that the recording medium has been disposed of and the particular information, which are correlated with each other, to an information management system that is externally connected to a network, if the judging section judges that the recording medium has not been disposed of by the disposal processing section, information that the recording medium has not been disposed of and the particular information, which are correlated with each other, to an information management system that is externally connected to the network, if the total current consumption is above the predetermined level, to an information management system that is externally connected to a network, wherein the communication section does not notify the information management system if the total current consumption is below the predetermined level.

2. A disposal processing information management system comprising:

(i) the disposal processing apparatus according to claim 1, wherein the communication section notifies, when the judging section judges whether the recording medium has been disposed of by the disposal processing section, information indicating whether the recording medium has been disposed of and the particular information, which are correlated with each other, to an information managing section of the information management system; and (ii) the information managing section that manages management information of the recording medium.

3. A disposal processing apparatus comprising:

a disposal processing section that disposes of a recording medium, the disposal processing section includes a cutter that crushes into pieces or cuts the recording medium utilizing rotation of a motor;

an arrival detecting section that detects whether the recording medium has reached the disposal processing section and includes a current detecting section that detects a current consumption of the motor;

wherein the arrival detecting section includes a contact member to be brought into contact with the recording medium;

a transport direction detecting section that detects a transport direction of the recording medium through an action of the contact member;

a judging section that judges whether the recording medium has been disposed of completely by the disposal processing section based on a detection result of the transport direction of the recording medium and a detection result of a total current consumption of the motor being above a predetermined threshold value;

a particular information acquiring section that acquires particular information being attached to the recording medium; and a communication section that notifies, if the judging section judges that the recording medium has been disposed of by the disposal processing section, information that the recording medium has been disposed of and the particular information, which are correlated with each other, to an information management system that is externally connected to a network, if the judging section judges that the recording medium has not been disposed of by the disposal processing section, information that the recording medium has not been disposed of and the particular information, which are correlated with each other, to the information management system that is externally connected to the network, if the total current consumption is above the predetermined level, to an information management system that is externally connected to a network, wherein the communication section does not notify the information management system if the total current consumption is below the predetermined level.

4. A disposal processing apparatus comprising:

a disposal processing section that disposes of a recording medium, the disposal processing section includes a cutter that crushes into pieces or cuts the recording medium utilizing rotation of a motor;

at least one transport section that transports the recording medium to the disposal processing section;

an arrival detecting section that detects whether the recording medium has reached the disposal processing section, wherein the arrival detecting section includes a passage detecting section that detects a passage of the recording medium and includes a current detecting section that detects a current consumption of the motor;

the passage detecting section is disposed on an upstream of the disposal processing section, and the closest point to the disposal processing section, and the passage detecting section that is disposed in a recording medium transport passage of said at least one transport section;

a judging section that judges whether the recording medium has been disposed of completely by the disposal processing section based on a detection result of the passage of the recording medium and a detection result of a total current consumption of the motor being above a predetermined threshold value;

a particular information acquiring section that acquires particular information being attached to the recording medium; and a communication section that notifies, if the judging section judges that the recording medium has been disposed of by the disposal processing section, information that the recording medium has been disposed of and the particular information, which are correlated with each other, to an information management system that is externally connected to a network, if the judging section judges that the recording medium has not been disposed of by the disposal processing section, information that the recording medium has not been disposed of and the particular information, which are correlated with each other, to the information management system that is externally connected to the network, if the total current consumption is above the predetermined level, to an information management system that is externally connected to a network, wherein the communication section does not notify the information management system if the total current consumption is below the predetermined level.

5. A disposal processing method for disposing of a recording medium with a cutter of a disposal processing section utilizing rotation of a motor, the method comprising:

detecting whether the recording medium has reached the disposal processing section by a current consumption of the motor;

judging whether the recording medium has been disposed of completely by the disposal processing section based on a detection result of a total current consumption of the motor being above a predetermined threshold value;

acquiring particular information being attached to the recording medium; and notifying, if the judgment indicates that the recording medium has been disposed of by the disposal processing section, information that the recording medium has been disposed of and the particular information which are correlated with each other, to an information management system that is externally connected to a network, notifying, if the judgment indicates that the recording medium has not been disposed of by the disposal processing section, information that the recording medium has not been disposed of and the particular information, which are correlated with each other, to the information management system that is externally connected to the network, notifying, if the total current consumption is above the predetermined level, to an information management system that is externally connected to a network, and not notifying, if the total current consumption is not below the predetermined level, to an information management system that is externally connected to a network.

* * * * *